United States Patent [19]

Bachman

[11] 4,018,604

[45] Apr. 19, 1977

[54] FREE RADICAL PHOTOSENSITIVE COMPOSITIONS WITH IMPROVED SENSITIVITY AND SHELF LIFE STABILITY

[75] Inventor: Paul L. Bachman, Cleveland Heights, Ohio

[73] Assignee: Horizons Incorporated, a division of Horizons Research Incorporated, Cleveland, Ohio

[22] Filed: Jan. 14, 1976

[21] Appl. No.: 648,973

[52] U.S. Cl. ..... 96/48 R; 96/27 E; 96/48 QP; 96/90 R; 96/67; 96/50 PL

[51] Int. Cl.[2] ..... G03C 5/24; G03C 1/52

[58] Field of Search ..... 96/27 E, 48 R, 90 R, 96/90 PC, 67, 50 PL, 48 QP

[56] References Cited

UNITED STATES PATENTS

| | | | |
|---|---|---|---|
| 3,042,515 | 7/1962 | Wainer | 96/90 R |
| 3,042,516 | 7/1962 | Wainer | 96/90 R |
| 3,102,810 | 9/1963 | Sprague et al. | 96/90 R |
| 3,351,467 | 11/1967 | Sprague, et al. | 96/90 R |
| 3,442,649 | 5/1969 | Rasch et al. | 96/50 PL |
| 3,488,290 | 1/1970 | Gerhardt et al. | 96/90 PC |
| 3,510,300 | 5/1970 | Fotland et al. | 96/90 R |
| 3,697,272 | 10/1972 | Ramins | 96/90 R |

*Primary Examiner*—Won H. Louie, Jr.
*Attorney, Agent, or Firm*—Lawrence I. Field

[57] ABSTRACT

This invention relates to free-radical, non-silver,-photosensitive films, particularly those suitable for optical development as described in United States Patent 3,510,300. The invention comprises the incorporation of metal di-substituted dithiocarbamates and dithiophosphinates into otherwise known photosensitive compositions to inhibit fog formation and to provide aging stability to such compositions. Preferably, an additional improvement comprises provision of an overcoat for the photosensitive composition of this invention when in the form of thin films on a support such as a polyester of a paper sheet or glass plate. The overcoat acts to improve the shelf life and photosensitometric properties of the photosensitive composition.

7 Claims, No Drawings

FREE RADICAL PHOTOSENSITIVE COMPOSITIONS WITH IMPROVED SENSITIVITY AND SHELF LIFE STABILITY

This invention relates to free-radical, non-silver, photosensitive films particularly those suitable for optical development as described in U.S. Pat No. 3,510,300 issued May 5, 1970.

The present invention is addressed to the improvement of the compositions described in that patent and in other prior art, which compositions consist essentially of:

1. a source of free-radicals, usually an organic halogen compound which produces a free-radical when exposed to a suitable dose of radiation, hereinafter referred to as an activator; and 2. at least one compound which prints out an image in areas in which such free-radicals are produced.

In two other United States Patent Applications Ser. Nos. 641,031 and 641,032 each entitled "Non-Silver Photosensitive Compositions with Improved Resistance to Dark Fogging", filed on Dec. 15, 1975, the use of organic sulfides, disulfides, sulfones, sulfoxides, thiosulfinates, bis-sulfides and sulfinyl esters as effective inhibitors of fog formation for such non-silver organic, free-radical photosensitive compositions has been described. It has now been found that metal disubstituted dithiocarbamates and dithiophosphinates are not only also effective in inhibiting fog formation in said compositions, but furthermore, also provide aging stability for amplification by optical development thereby permitting the attainment of higher photographic speeds, than are attained by otherwise similar compositions to which the dithio compounds have not been added.

Fotland and Fichter in U.S. Pat. No. 3,510,300 issued May 5, 1970, describe the process of optical development wherein a non-silver, organic free-radical photosensitive composition, comprising an activator (usually an organic halogen compound) and a dye base or leuco triarylmethane dye progenitor, is given a blanket exposure to radiation of suitable wavelength for rendering visible a latent image. Lewis and Shirey in U.S. Pat. No. 3,697,276 issued Oct. 10, 1972 also describe this process for use with compositions comprising an N-vinylamine and an organic halogen compound which acts as an activator. Ramins in U.S. Pat. No. 3,697,272 issued Oct. 10, 1972 describes an improved process wherein exposure to radiation of two different wavelengths produces greater photographic speeds of photosensitive compositions comprising styryl quinoline dye progenitors employing a halogen activator.

It has been found that the optical development process is also applicable to compositions comprising a halogen activator in combination with at least one dye base and at least one leuco progenitor, as described in the above noted patent applications (325 B2 and B3) to produce photographic speeds in the range of $10^{-2}$ to 1 ASA, However, such compositions exhibit such poor shelf life stability toward the optical development process that a sizeable loss of development capability, and consequently photographic speed, occurs within fifteen minutes to one hour of preparation.

In the above noted applications (325 B2 and B3) the use of certain sulfur-containing stabilizers is described. Such stabilizers have been found to inhibit the formation of dark fog in the compositions while they are stored, awaiting exposure. Even though these stabilizers inhibit fog, thereby providing improved stability for printout exposures, it has been noted that they interfere with the optical development process to such an extent that films containing these stabilizers cannot be optically developed upon aging, while in some instances, these additives even interfere with the development of freshly prepared films.

The use of the metal disubstituted dithiocarbamates and dithiophosphinates of the present invention produces a significant improvement over the stabilizers described in the above noted applications in that they stablize against dark fogging while not adversely affecting the optical development process. In some instances their presence improves the aged development as compared to development in the absence of any such stabilizer.

The stability of the photosensitive compositions of this invention is an extremely complex, incompletely understood phenomenon. An earlier filed application Ser. No. 364,092 filed May 25, 1973 describes one manner of overcoming external causes of instability such as oxidizing and acidic contaminants as well as the physical loss of volatile halogen activator. Applications 325 B2 and 325 B3 are directed to overcoming dark fogging which constitutes one form of internal chemical instability. It appears that the optical development process may operate by a different mechanism than the printout process, with its own set of internal chemical instabilities. Thus, while not wishing to be bound by any specific theory, it appears that at least parts of the optical development mechanism operate independently from the mechanism of dark fogging and that the stabilizers described in co-pending applications 325 B2 and B3, while effective against dark fog, coincidentally and simultaneously interfere with some stage of the optical development mechanism. In contrast, the stabilizers of the present invention are effective in inhibiting dark fog formation without detrimentally interfering with the optical development mechanism and in some instances have been found to favorably affect the development mechanism.

The metal disubstituted dithiocarbamates (Ia, b) and metal disubstituted dithiophosphinates (II) which are suitable for this invention are represented by structures I and II respectively

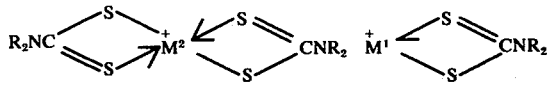

(Ia) (Ib)

$$M^{+n}[-SP(OR)_2]_n$$

(II)

wherein n is 1 or 3 and where the metal may be selected from $Na^+$, $K^+$, $Zn^{+2}$, $Cd^{+2}$, $Hg^{+2}$, $Fe^{+2}$, $Ni^{+2}$, $Co^{+2}$, $Cu^{+2}$, and $[BiR']^{+2}$ where R' is alkyl or aryl and where R is lower alkyl, aryl, aralkyl or alicyclic. They are effective in the range of 1/2 to $10^{-3}$ the concentration of leuco compound with the preferred concentration being $10^{-1}$ to $10^{-2}$ Typical examples include but are not restricted to:

zinc dimethyl dithiocarbamate
zinc dibenzyl dithiocarbamate zinc diethyl dithiocarbamate
zinc dibutyl dithiocarbamate
zinc ethylenebis dithiocarbamate
nickel dimethyl dithiocarbamate
nickel dibutyl dithiocarbamate
nickel cyclopentamethylene dithiocarbamate
cadmium cyclopentamethylene dithiocarbamate
bismuth dimethyl dithiocarbamate
lead dimethyl dithiocarbamate
lead diethyl dithiocarbamate
sodium dimethyl dithiocarbamate
sodium diphenyl dithiocarbamate
phenylmercuric dimethyl dithiocarbamate
cadmium di-N-propyl dithiophosphate
cadmium diisopropyl dithiophosphate
potassium di-N-propyl dithiophosphate
potassium diisopropyl dithiophosphate
nickel di-N-propyl dithiophosphate
nickel diisopropyl dithiophosphate
bismuth di-N-propyl dithiophosphate
bismuth diisopropyl dithiophosphate
zinc di-N-propyl dithiophosphate
zinc diisopropyl dithiophosphate
cupric di-N-propyl dithiophosphate
cupric diisopropyl dithiophosphate In addition to the dithiocarbamate or dithiophosphinate which stabilizes the photosensitive composition, the composition consists essentially of (1) at least one leuco compound, (2) at least one dye base, (3) at least one activator, (4) a suitable binder, and (5) any of a large number of consitutents which may be added for a particular purpose and which may be considered optional. These constituents are described more extensively in the prior art including U.S. Pat. Nos. 3,285,744 issued Nov. 15, 1944, U.S. Pat. No. 3,510,309 issued May 5, 1970 and U.S. Pat. No. 3,042,515 issued July 3, 1962, the disclosures of which are intended to be incorporated herein by this reference.

LEUCO COMPOUNDS

The leuco compounds useful in the practice of the present invention include Leuco Crystal Violet, Leuco Malachite Green, Leuco Opal Blue and other leuco triaryl methane compounds as well as other leuco compounds such as leuco anthracenes, leucoxanthenes, leucothioxanthenes and leuco acridenes.

DYE BASES

Styryl and cyanine dye bases suitable for the photosensitive compositions of the present invention are described in U.S. Pat. Nos. 3,100,703 issued Aug. 13, 1963, 3,102,810 issued Sept. 3, 1963 and 3,095,303 issued June 25, 1963 and suitable merocyanine dye bases are described in U.S. Pat. No. 3,109,736 issued Nov. 5, 1963.

FREE RADICAL SOURCES

The leuco compounds and dye bases described above experience a color change or print out an image when in the presence of free radicals produced as a result of the exposure of certain classes of compounds, to suitable electromagnetic radiation. The organic halogen compounds which are suitable in the light sensitive compositions to which the present invention is applicable are those represented by the general formula A-C:$X_3$ wherein A represents halogen (C1, Br or I), alkyl, substituted alkyl, including halogen substituted alkyl, aryl, substituted aryl, aroyl, and aralkyl and each X represents a halogen atom which may be either chlorine, bromine or iodine, it being understood that not all of the X atoms need be alike. Bromine is a preferred X and preferred compounds are halogen substituted alkanes, e.g. $CBr_4$, $CHI_3$, $C_2HBr_5$, etc., and $\alpha,\alpha,\alpha$,-tribromoacetophenone.

BINDER

One convenient way of utilizing the photosensitive compositions of this invention is to dissolve all of the constituents in a solvent or mixture of solvents and then cast the solution into an inert support such as glass, or a synthetic resin polymer or to dip an absorbent material such as paper into the solution. To preserve the association of constituents after the solvent has evaporated, it is preferred to include a film forming binder in the composition as described in any of the above noted patents.

OPTIONAL CONSTITUENTS

Other constituents which may be added to produce special benefits may include compounds to alter the sensitivity, or to plasticize or otherwise modify the composition, without departing from the intended scope of the invention. The addition of N-oxides as described in U.S. Pat. No. 3,481,739 issued Dec. 2, 1969 is one such particularly preferred, optional addition, optional for the direct printout mode of this invention but essential for the optical development mode.

PROPORTIONS

The compositions of this invention have the following proportions of the several components:

| Constituent | Broad Range | Preferred |
|---|---|---|
| Organic Halogen Compound | 10 – .10 | 4 – 1 |
| Leuco Dye | .1 – .01 | .4 – .1 |
| Dye Base | .5 – .01 | .2 – .05 |
| Dithiocarbamate or Dithiophosphinate | .5 – .001* | .1 – .01* |
| Binder | 1 | 1 |

*times the weight of leuco compound

The use of organic sulfur compounds to stabilize the photosensitive compositions against fogging should not be confused with the use of organic sulfur compounds in non-silver free radical photosensitive compositions such as those described in the following U.S. Pat. Nos. and other of similar nature:

3,042,516 issued July 3, 1962,
3,285,744 issued Nov. 15, 1966,
3,342,595 issued Sept. 19, 1967,
3,342,602 issued Sept. 19, 1967,
3,342,603 issued Sept. 19, 1967,
3,342,604 issued Sept. 19, 1967,
3,351,467 issued Nov. 7, 1967,
3,510, 309 issued May 5, 1970,
3,533,792 issued Oct. 13, 1970,
3,573,911 issued Apr. 6, 1971. *times the weight of leuco compound These patents disclose the use of heterocyclic organic sulfur compounds for entirely different purposes.

In U.S. Pat. Nos. 3,285,744; 3,342,595; 3,342,602; 3,342,603; 3,342,604 and 3,481,739 the use of heterocyclic mercaptans, heterocyclic disulfides, heterocyclic sulfur compounds, thioureas and thioacetanilides as activators are described.

In U.S. Pat. No. 3,351,467 the use of leuco xanthenes as the color forming compound and thiazoles as activators is described.

In U.S. Pat. No. 3,573,911 the use of arylthioketones as color forming compounds is described.

In U.S. Pat. No. 3,533,792 the use of thiols, pyrazolones and thioacetanalides to form a colored reaction product is described.

None of the above describes the use of the present sulfur compounds as stabilizers against fog formation.

The invention will be further understood from the examples which follow which are intended to further illustrate the invention and not to limit the same.

EXAMPLE I (PRIOR ART)

A photosensitive composition was prepared by dissolving 2,7-bis(dimethylamino)-10-p-dimethylaminophenyl-9,10-dihydro-9,9-dimethylanthracene (100 mg), 4-picoline-N-oxide (20 mg), 2-(p-dimethylaminostyryl)-quinoline (64 mg) and carbon tetrabromide (1.2 g) in 4.5 ml. of a 10% by weight solution of Styron 686 polystyrene in benzene in total darkness. The solution was coated 0.0015 inches wet thickness on 500 D Mylar polyester using a vacuum channel plate and Bird drawbar applicator. The film was allowed to air-dry several minutes, then removed from the coating plate and cut into two strips one of which was placed in a box and stored at ambient temperature.

Exposures were made through a standard Kodak Type 1A step tablet to a uniform light source corrected to a color temperature of 5700°K. The first strip was given a 58,000 meter-candle-second (MCS) printout exposure and then fixed by rinsing for several minutes in a solution of petroleum ether/acetone/Stoddard solvent (8:2:1 by volume). The resulting seven step magenta image, as read with a Wratten 93 green filter, had Dmax 1.86 and base plus fog (B+F) 0.07.

The second strip was identically processed after five hours storage to give a three step magenta image with Dmax 0.80 and B+F 0.07.

EXAMPLE II (PRIOR ART)

A photosensitive film was prepared according to Example I and a polyvinylalcohol overcoat was then applied. After the photosensitive layer had air-dried several minutes, a 10% aqueous solution of Elvanol 52-22 polyvinylalcohol was applied with a draw bar at a wet thickness of 0.006 inches and allowed to air dry for fifteen minutes before cutting the film into two pieces. The overcoat was removed from the first strip by evenly applying a piece of masking tape and carefully lifting. This strip was then given a 58,000 MCS direct printout exposure and processed as in Example I. The result was a seven-step magenta image with Dmax 1.82 and B+F 0.07. The second strip was processed identically after five hours storage at ambient temperature to give a seven-step magenta image with Dmax 1.90 and B+F 0.15.

EXAMPLE III

Photosensitive compositions and overcoated films were prepared according to Example II with a dithiocarbamate or dithiophosphinate added. The films were identically exposed and processed according to Example II with films freshly prepared and also with the same films after aging three and twenty-four hours. The effects on buildup of dark fog can be seen from Tables 1A and 1B which follow.

Table 1A

Effect of Metal N,N-Disubstituted Dithiocarbamates

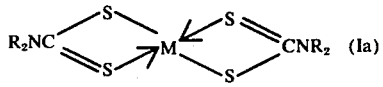

(Ia)

| M | R | Amount (mg) | B+F at x-hours 0 | 3 | 24 |
|---|---|---|---|---|---|
| Control | — | — | .09 | .13 | .25 |
| Zn | benzyl | 1.5 | .08 | .08 | .08 |
| Zn | n-butyl | 1.5 | .06 | .08 | .07 |
| Zn | n-butyl | 4.7 | .07 | .07 | .08 |
| Zn | ethyl | 1.0 | .08 | .08 | .07 |
| Zn | ethyl | 3.6 | .06 | .07 | .06 |
| Zn | ethylene bis | 1.0 | .12 | .12 | .07 |
| Pb | methyl | 1.0 | .08 | .08 | .10 |
| Pb | methyl | 4.5 | .08 | .09 | .08 |
| Cd | cyclopentyl | 1.0 | .08 | .08 | .08 |
| Cd | cyclopentyl | 4.3 | .07 | .08 | .07 |
| Bi | methyl | 1.0 | .10 | .09 | .12 |
| Hg | methyl | 1.5 | .08 | .07 | .10 |

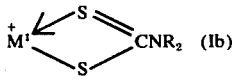

(Ib)

| | | | | | |
|---|---|---|---|---|---|
| Na | phenyl | 1.0 | .10 | .06 | .09 |
| Na | phenyl | 6.0 | .12 | .09 | .09 |

Table 1B

Effect of Metal Disubstituted Dithiophosphinates on Dark Fogging

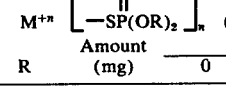

(II)

| M | n | R | Amount (mg) | B+F at x-hours 0 | 3 | 24 |
|---|---|---|---|---|---|---|
| — | Control | | | 0.09 | .13 | .25 |
| K | 1 | n-propyl | 1.0 | .07 | .06 | .07 |
| K | 1 | i-propyl | 2.5 | .07 | .07 | .07 |
| Cd | 2 | i-propyl | 1.0 | .07 | .08 | .09 |
| Cd | 2 | i-propyl | 5.4 | .08 | .08 | .08 |
| Ni | 2 | i-propyl | 1.0 | .08 | .08 | .10 |
| Ni | 2 | i-propyl | 4.8 | .08 | .07 | .12 |
| Ni | 2 | n-propyl | 4.8 | .08 | .08 | .08 |
| Zn | 2 | i-propyl | 1.0 | .08 | .08 | .07 |
| Zn | 2 | i-propyl | 4.9 | .06 | .07 | .07 |
| Zn | 2 | n-propyl | 1.0 | .06 | .07 | .06 |

EXAMPLE IV

By way of further examples a photosensitive composition was prepared by dissolving 2,7-bis(dimethylamino)-10-p-dimethylaminophenyl-9,10-dihydro-9,9-dimethylanthracene (100 mg), 5-ethylpyridine-N-oxide (30 mg), 4-(p-dimethylaminostyryl)-quinoline (50 mg), carbon tetrabromide (1.4 g) in 4 ml of a 10% by weight solution of Lustrex H101 polystyrene in benzene to which a dithiocarbamate (I) or dithiophosphinate (II) was added. A film was prepared and overcoated with a 7% by weight aqueous solution of Gelvitol 20-60 polyvinylalcohol according to the methods of Examples I and II. Strips were exposed and processed according to Example II, fresh and after three and twenty-four hours storage at ambient temperature. The results are shown in Table 2.

Table 2

| Additive Type | M | R | Amount (mg) | B+F After x-hours 0 | 3 | 24 |
|---|---|---|---|---|---|---|
| — | (Control) | — | | .06 | .28 | .45 |
| I | Zn | n-butyl | 3.0 | .09 | .09 | .10 |
| I | Pb | methyl | 3.0 | .09 | .09 | .09 |
| II | Cd | i-propyl | 0.5 | .07 | .08 | .08 |
| II | Cd | i-propyl | 0.05 | .08 | .08 | .09 |
| II | Cd | n-propyl | 0.05 | .08 | .08 | .10 |

EXAMPLE V

The control formulation of the preceding example was modified by the addition of the metal disubstituted dithiocarbamate (Type I) or dithiophosphinate (Type II) listed below. A freshly prepared strip was given a white light exposure of 15 MCS with the overcoat in place. The overcoat in place. The overcoat was then removed and the film developed by blanket exposure at a distance of four inches from a red light produced by filtering a Marc 300 tungsten iodide lamp fitted with a parabolic reflector and a Wratten 89 B gelatin filter placed over a Corning 2055 glass filter. The film was then fixed by rinsing for several minutes in a solution of petroleum ether/acetone/Stoddard solvent (8:2:1 by volume). After aging one hour at ambient temperature each film was exposed and processed in identical fashion. The effect of these compounds on retention of development capability can be seen in Table 3.

Table 3

| Type | M | R | Am't (mg) | No. of Steps | B+F | Dmax | Devel. Time (sec) | ASA |
|---|---|---|---|---|---|---|---|---|
| | Control | | | | | | | |
| I | $Cd^{+2}$ | cyclo-pentyl | 1.0 | 7 | .15 | 2.03 | 125 | .19 |
| I | $Pb^{+2}$ | methyl | .0 | 7 | .19 | 2.01 | 90 | .52 |
| I | $Pb^{+2}$ | methyl | 4.5 | 7 | .13 | 1.99 | 95 | .36 |
| II | $K^+$ | n-propyl | 1.0 | 6 | .07 | 1.47 | 87 | .056 |
| II | $K^+$ | n-propyl | 2.5 | 7 | .07 | 2.10 | 110 | .22 |
| II | $K^+$ | i-propyl | 2.5 | 6 | .07 | 1.06 | 90 | .014 |
| II | $Cd^{+2}$ | i-propyl | 1.0 | 6 | .15 | 1.23 | 150 | .02 |
| II | $Cd^{+2}$ | i-propyl | 5.4 | 6 | .20 | .096 | 100 | .009 |
| II | $Ni^{+2}$ | i-propyl | 1.0 | 6 | .35 | 1.96 | 85 | .014 |
| II | $Ni^{+2}$ | i-propyl | 4.8 | 7 | .32 | 1.71 | 88 | .042 |
| II | $Ni^{+2}$ | n-propyl | 1.0 | 6 | .31 | 1.53 | 65 | 0.010 |

Having now described preferred embodiments of this invention, it is not intended that it be limited except as defined in the claims which follow.

I claim:

1. In a photosensitive composition consisting essentially of:

1. at least one leuco diaryl or triaryl methane dye forming compound;
2. at lease one dye base selected from the group consisting of styryl dye bases, cyanine dye bases and merocyanine dye bases;
3. at least one organic halogen compound which provides free radicals when exposed to a suitable dose of radiation; and a film forming polymer in which constituents (1), (2) and (3) are supported;

the improvement which comprises including in said composition an organic sulfur compound selected from the group consisting of a. metal disubstituted dithiocarbamates represented by one of the following formula:

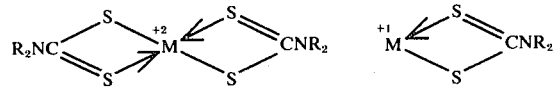

(Ia) (Ib)

wherein R is selected from the group consisting of alkyl, aryl, aralkyl and alicyclic and both R's are not required to be the same and M is a metal selected from the group consisting of $Na^+$, $K^+$, $Zn^{+2}$, $Cd^{+2}$, $Hg^{+2}$, $Fe^{+2}$, $Ni^{+2}$, $Co^{+2}$, $Cu^{+2}$, and $[BiR']^{+2}$ where R' is alkyl or aryl; and b. metal disubstituted dithiophosphinates represented by the formula:

$$M^{+n}[-S\overset{\overset{\displaystyle S}{\|}}{P}(OR)_2]_n \qquad \text{(II)}$$

wherein n is 1 or 2 and wherein M is a metal selected from the group consisting of $Na^+$, $K^+$, $Zn^{+2}$, $Cd^{+2}$, $Fe^{+2}$, $Ni^{+2}$, $Co^{+2}$, $Cu^{+2}$, and $[BiR']^{+2}$ where R' is alkyl or aryl and each R is selected from the group consisting of lower alkyl, aryl, aralkyl, or alicyclic the amount of metal disubstituted dithiocarbamate and metal disubstituted dithiophosphinate being effective to both inhibit fog formation in said composition and to provide aging stability for amplification by optical development of said composition.

2. The composition of claim 1 wherein the amount of sulfur compound is between 1/10th and 1/1000th the combined weight of leuco dye and dye base.

3. The composition of claim 2 wherein the amount of sulfur compound is between 1/2 to 1/1000th the combined weight of leuco dye and dye base.

4. The composition of claim 1 wherein $R_1$ and $R_2$ are t-butyl.

5. A method of producing a visible image which comprises: preparing a member including a thin dried layer of photosensitive composition in accordance with claim 1; exposing said layer to a pattern of visible light thereby producing a visible image on the areas exposed to visible light and thereafter fixing the image.

6. A method of producing a visible image which comprises: preparing a member including a thin dried layer of photosensitive composition in accordance with Claim 1; depositing on top of said layer of photosensitive composition a layer of solution containing polyvinyl alcohol; drying said solution; exposing said dried layers to a pattern of visible light; thereby producing a visible image on the areas exposed to visible light; mechanically removing the polyvinyl alcohol containing overcoat; and thereafter fixing the image.

7. The method of claim 6, wherein after mechanical removal of the dried overcoat containing polyvinyl alcohol, the imagewise exposed photosensitive layer is then given a blanket exposure to red light having a wavelength longer than 600 nanometers thereby producing a visible image on the areas first exposed to the pattern of visible light; and thereafter fixing the image.

* * * * *